US005280652A

United States Patent [19]

Davis et al.

[11] Patent Number: 5,280,652

[45] Date of Patent: Jan. 25, 1994

[54] GARMENT WAISTBAND CONSTRUCTION

[75] Inventors: Robert E. Davis, Winston-Salem; William Flinchum, Clemmons; Howard D. Boyles, King, all of N.C.

[73] Assignee: Sara Lee Corporation, Winston-Salem, N.C.

[21] Appl. No.: 836,790

[22] Filed: Feb. 14, 1992

[51] Int. Cl.[5] ..... A41B 11/04

[52] U.S. Cl. ..... 2/409; 2/239; 66/178 R; 66/178 A; 66/177; 66/176

[58] Field of Search ..... 2/409, 239; 66/178 R, 66/178 A, 177, 176

[56] References Cited

U.S. PATENT DOCUMENTS

| | | | |
|---|---|---|---|
| Re. 25,360 | 3/1963 | Rice | 2/409 |
| 2,826,760 | 3/1958 | Rice | 2/409 |
| 3,595,034 | 7/1971 | Safrit | 2/409 |
| 3,914,799 | 10/1975 | Newmar | 2/409 |
| 4,021,861 | 5/1977 | Imboden et al. | 2/409 |
| 4,150,554 | 4/1979 | Cassidy | 66/172 |
| 4,267,607 | 5/1981 | Tino | 2/409 |
| 4,390,999 | 7/1983 | Lawson et al. | 2/409 |
| 4,445,345 | 5/1984 | Bedier | 2/409 |
| 4,872,324 | 10/1989 | Rearwin et al. | 66/172 |
| 4,875,241 | 10/1989 | Browder, Jr. et al. | 2/409 |

FOREIGN PATENT DOCUMENTS

| | | | |
|---|---|---|---|
| 2309164 | 11/1976 | France | 2/409 |

*Primary Examiner*—Clifford D. Crowder
*Assistant Examiner*—Gloria Hale

[57] ABSTRACT

A pantyhose or the like garment having a novel waistband construction comprising an anchor portion and an integrally knit wide band portion. The waistband is substantially wider than conventional waistbands, the anchor portion consisting of a narrow turned welt portion and a wide single ply band portion, each incorporating textured nylon and elastomer yarns.

7 Claims, 1 Drawing Sheet

GARMENT WAISTBAND CONSTRUCTION

BACKGROUND, BRIEF SUMMARY, AND OBJECTS OF THE INVENTION

This invention relates generally to a pantyhose garment having a new and improved waistband consisting of an anchor portion and a wide band portion. This is in contrast to known conventional pantyhose garments.

It is the conventional practice to produce a pantyhose garment incorporating a turned welt defining an elastic waistband, a single ply upper panty portion, and leg portions, the toe ends of which may be closed in any suitable manner.

A conventional two ply, turned welt waistband includes spandex or other suitable type of elastic yarn for providing an inward compressive force against the waist of a wearer to aid in maintaining the waistband in position when the pantyhose garment is worn. A normal waistband consists of approximately 300 courses and has a width of approximately ½ inch to ¾ inch. One of the problems of such conventional pantyhose is the tendency of a typical elasticized waistband to slip down the waist and hips of a wearer as a result of movements performed in ordinary day-to-day activities. Attempting to overcome the slippage problem by constructing the waistband so as to be more constructing and tight fitting results in a waistband which uncomfortably binds and constricts a wearer's waist.

In the present invention, the pantyhose garment includes a new and improved waistband comprising a relatively narrow anchor section of a turned welt construction and a relatively wide band section of a single layer integral therewith and depending therefrom. Such waistband construction, which may range in width up to five inches eliminates the binding and cutting problem of convention waistbands.

In one embodiment the anchor portion may consist of a turned welt which includes textured nylon or other synthetic yarn knit in every course and bare elastomer yarn floated in selected courses. The elastomer yarn is floated in selected courses to provide more linear compression in a coursewise direction in the turned welt portion of the wide waistband. The relatively wide band portion includes textured nylon in every course and elastomer yarn knitted in every course or every other course. In the wide band portion of the improved waistband, knitting the nylon yarn in every course and the elastomer yarn in every course or every other course provides a more balanced compression, walewise and coursewise.

A primary object of the invention is the provision of a pantyhose garment having an elongated waistband which conforms comfortably to the contour of the wearer's body and resists slippage.

Another object of the invention is the provision of a pantyhose garment having an improved, elasticized, knitted waistband construction.

A further object of the invention is the provision of a new and improved elastic waistband incorporating a relatively narrower turned welt anchor portion and a relatively wider band portion. Other objects and advantages of the invention will become apparent when considered in view of the following detailed description.

Although the new waistband construction is described in conjunction with the panty portion of a pantyhose garment, it is to be understood that such concept may also be applied to other types of lower body garments, including tights and the like.

The term "elastomer" as used in the specification and claims is intended to identify any rubber or plastic material, including spandex, having stretchability and recovery properties or qualities.

DETAILED DESCRIPTION OF THE INVENTION

Figure 1:
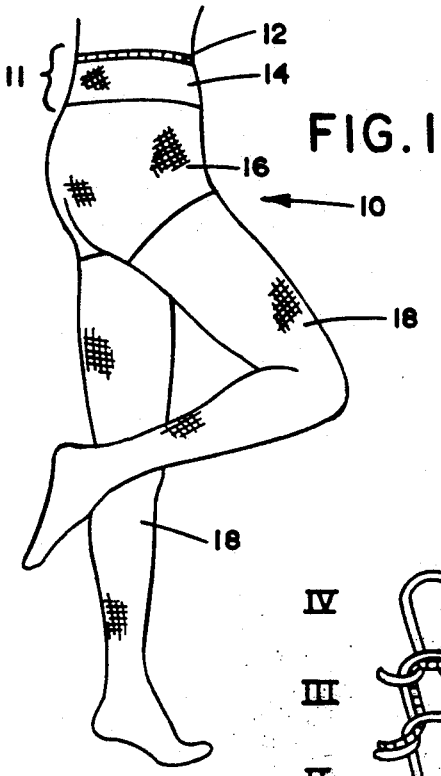
FIG. 1 is a perspective view of a pantyhose type garment embodying the anchor portion and the wide band portion of the new waistband of the present invention.

The pantyhose garment 10 of FIG. 1 is formed from a pair of seamless knit blanks having a length sufficient to extend from the waist to the toe of a wearer. The blanks incorporate the anchor and wide band portions. The blanks are slit a predetermined amount and the slit edges of the two blanks are sewn together with a substantially u-shaped seam which extends from the waist downwardly through the crotch area and back up to the waist, resulting in the garment of FIG. 1.

The garment 10 includes a wide waistband 11 having a turned welt anchor section 12 and a wide band section 14, a panty section 16, and leg portions 18,18.

Figure 3:
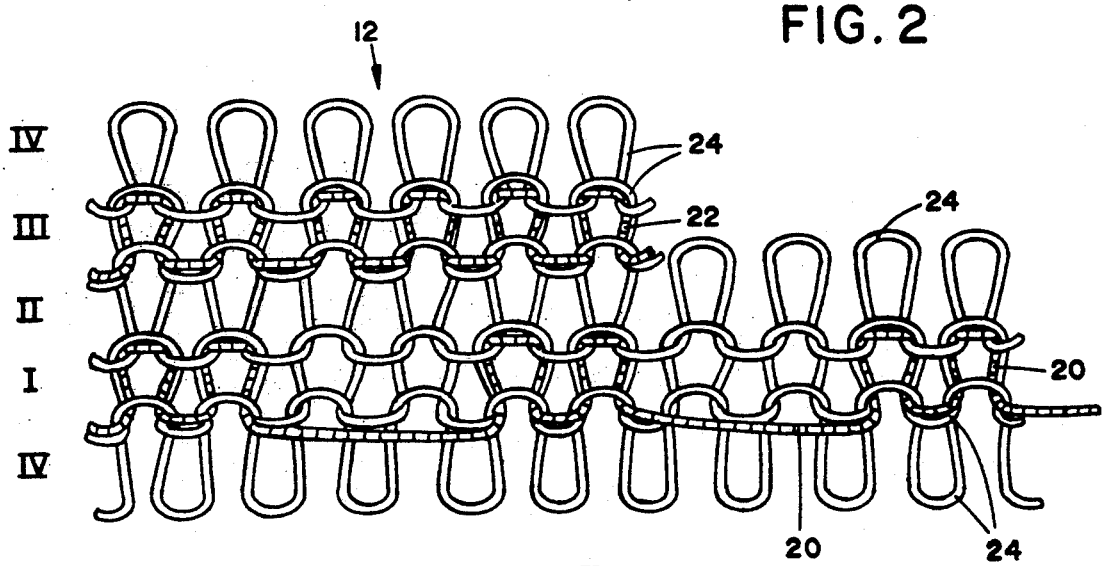
FIG. 3 is a diagrammatic elevational view of an inner portion of one ply of the knitted construction of the turned welt anchor portion in accordance with one embodiment of the present invention.

The turned welt anchor portion 12 includes a plain knit construction of textured nylon having bare elastomer yarn selectively incorporated therewith. FIG. 3 illustrates selected courses of an inner portion of one ply of the turned welt anchor portion. The textured nylon is incorporated in every course and the bare elastomer yarn is incorporated in alternate courses in the embodiment of FIG. 3. The courses identified as I, II, III, and IV are repeated in identical sequence throughout the combined area of the anchor section 12. In course I, elastomer yarn 20 is alternately knit across two stitches and floated across two stitches in order to provide more linear compression in a coursewise direction and in course III the elastomer yarn 22 is knitted in every stitch.

In the anchor section 12, the nylon yarn 24 knit in courses I through IV may be, for example, 40 denier, 13 filament textured yarn. The nylon yarn denier is selected to provide the correct bulk, and the elastomer yarn in Courses I and III can range from 70 denier to 560 denier depending upon the amount of garment vertical compression desired. The heavier denier is required for a support type garment and the lighter denier for a non-support garment. The criticality of denier relates to the type and size of garment being produced.

The width of the turned welt anchor section may be between ¼ inch up to or approaching 2 inches depending on the size and configuration of the garment.

Figure 2:
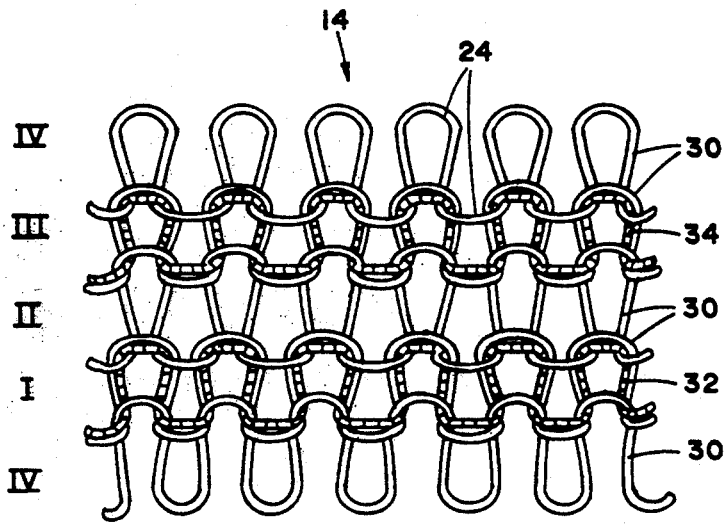
FIG. 2 is a diagrammatic elevational view of an inner portion of the knitted structure of the wide band portion of the waistband in accordance with one embodiment of the present invention.

The single ply wide band section 14 consists of a plain knit construction of textured nylon 30 knit in all courses and having elastomer yarns knit in every stitch of every other course. The width of the single ply section may be from 2 inches to 4 inches, but must be wider than the turned welt anchor portion. In FIG. 2, nylon yarn 30 is knit in each of courses I, II, III, and IV, such course I through IV being repeated in identical fashion throughout the combined area or width of the wide band section 14. An elastomer could be knit in every course of the wide band 14 if so desired. The yarn 30 in courses I through IV may be 40 denier, 13 filament textured nylon. While the elastomer yarns alternate in every other course, the types of elastomer yarns may also alternate throughout section 14. For example, the yarn 32 in course I may be 265 denier spandex and the yarn 34 in course III may be 70 denier spandex with such pattern repeating throughout the wide band section 14. Alternatively, spandex yarn may be knit in every course of section 14, the denier of the spandex yarn selectively being the same or alternating in successive courses. The spandex yarns may range from 70 denier to 560 denier depending upon the size and configuration of the garment.

The narrower anchor section 12 and the wide band section 14 combine to provide a waistband affording markedly enhanced comfort to the wearer.

What is claimed is:

1. In a lower body garment including a single-ply panty portion knit of successive courses, a waistband integrally knit with the single-ply panty portion for maintaining the garment in position on a wearer, said waistband including the combination of an anchor portion comprising a turned welt section and a band portion of single-ply construction integrally knit with said anchor portion and having a width substantially greater than the width of said anchor portion, each course of said anchor portion and said wide band portion including integrally knit successive courses of textured nylon, and at least alternate courses of each of said anchor portion and said wide band portion incorporating a bare elastomeric yarn.

2. In a lower body garment as recited in claim 1, said anchor portion incorporating spandex yarn in spaced apart courses.

3. In a lower body garment as recited in claim 2, wherein spandex yarn is in alternate courses in said anchor portion.

4. In a lower body garment as recited in claim 3, said spandex yarn in said anchor portion being selectively floated in selected courses.

5. In a lower body garment as recited in claim 1, said wide band single-ply construction portion including elastomeric yarn knit in alternate courses.

6. In a lower body garment as recited in claim 5, wherein said elastomeric yarn knit in alternate courses of said single-ply wide band portion includes a first bare elastomeric yarn of a selected denier knit in every fourth course and a second bare elastomeric yarn having a denier substantially four times the denier of said first bare elastomeric yarn and knit in courses intermediate every fourth course.

7. In a lower body garment, a panty portion and a waistband knit integral therewith, said waistband including a two-ply fabric construction anchor portion and a band portion of single-ply construction having a width substantially greater than the width of said anchor portion, said anchor portion including 40 denier, 13 filament textured nylon yarn knit in all courses and bare spandex yarn within the range of 70–265 denier selectively floated every fourth course, said band portion including 40 denier, 13 filament textured nylon yarn knit in every course and bare spandex within the range of 70–265 denier yarn knit in at least every other course.

* * * * *